United States Patent [19]

Masghati et al.

[11] Patent Number: 4,471,961

[45] Date of Patent: Sep. 18, 1984

[54] GOLF CLUB WITH BULGE RADIUS AND INCREASED MOMENT OF INERTIA ABOUT AN INCLINED AXIS

[75] Inventors: Mohammad Masghati, Grand Rapids, Mich.; Thomas F. Hardman, Palm Beach Gardens, Fla.

[73] Assignee: Pepsico, Inc., Purchase, N.Y.

[21] Appl. No.: 418,301

[22] Filed: Sep. 15, 1982

[51] Int. Cl.[3] ..... A63B 53/04

[52] U.S. Cl. ..... 273/175; 273/169

[58] Field of Search ..... 273/175, 167 C, 167 E, 273/167 J

[56] References Cited

U.S. PATENT DOCUMENTS 2,395,837 3/1946 Baymiller et al. ..... 273/175

3,625,518 12/1971 Solheim ..... 273/175

OTHER PUBLICATIONS

"Golf Digest", Jul. 1965, pp. 70–72, 74–75.

*Primary Examiner*—George J. Marlo

[57] ABSTRACT

A golf clubhead has weight distributed on opposite sides of a non-vertical axis which extends through the center of gravity of the clubhead in a plane which intersects the axis of the shaft above the clubhead to provide more accurate off-center hits. Wooden clubs are provided with bulge and roll which curve, respectively, about said axis and an axis perpendicular thereto. The radius of the roll is increased to make the loft of the club substantially uniform from top to bottom.

14 Claims, 24 Drawing Figures

FIG. 1A
PRIOR ART
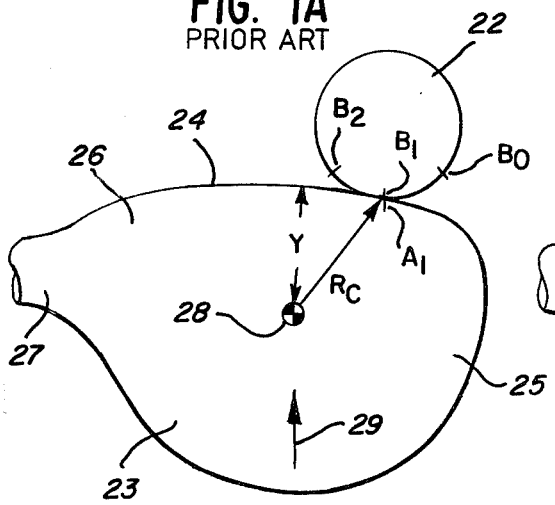
FIG. 1B
PRIOR ART
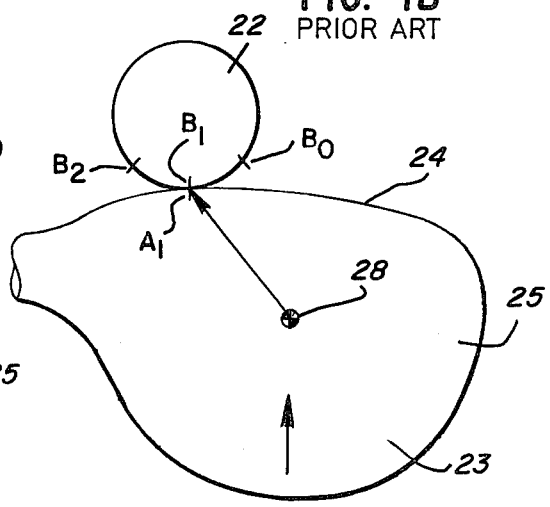
FIG. 2A
PRIOR ART
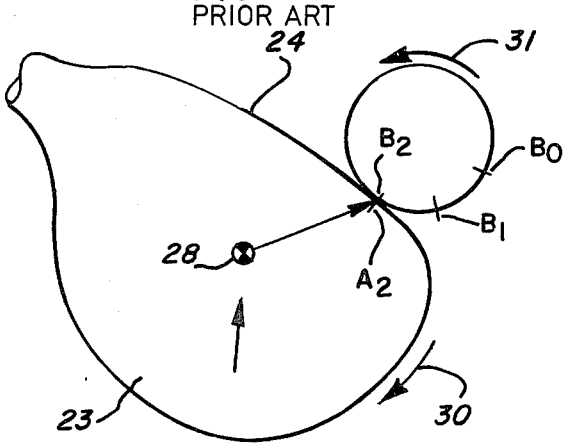
FIG. 2B
PRIOR ART
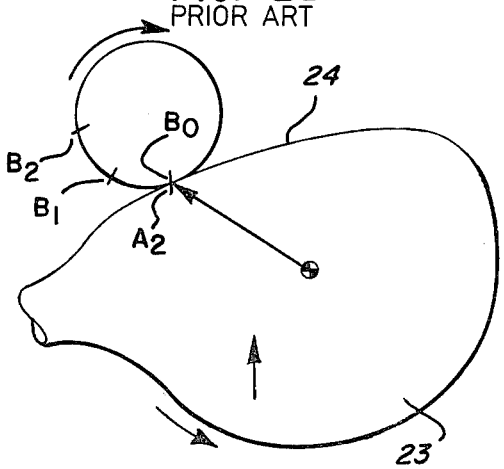
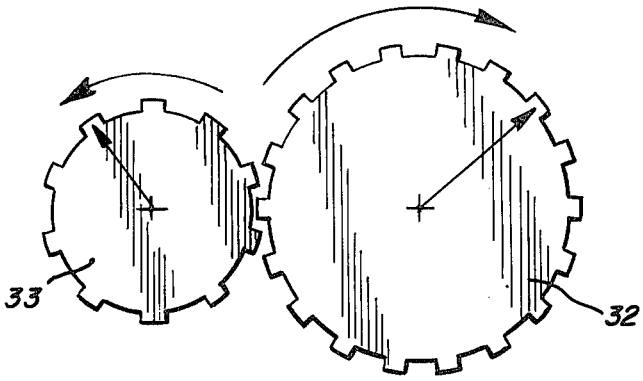
FIG. 3

FIG. 14
PRIOR ART
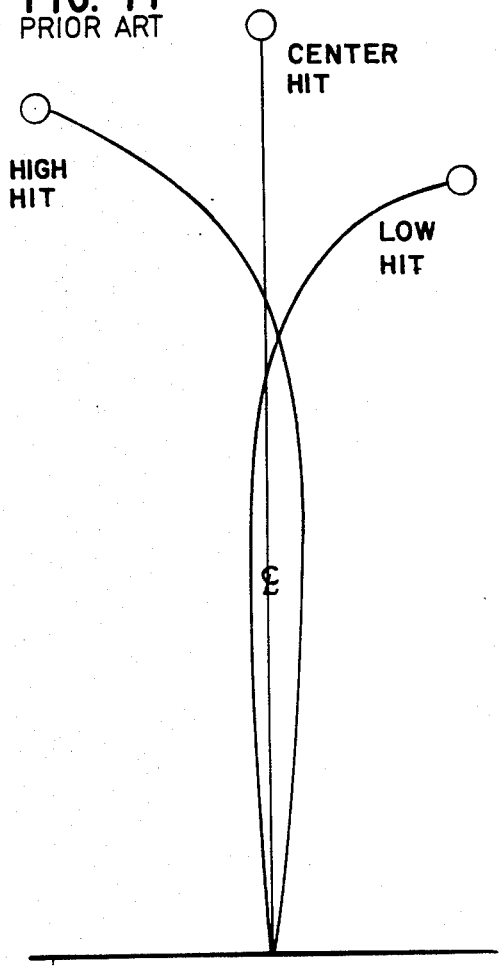
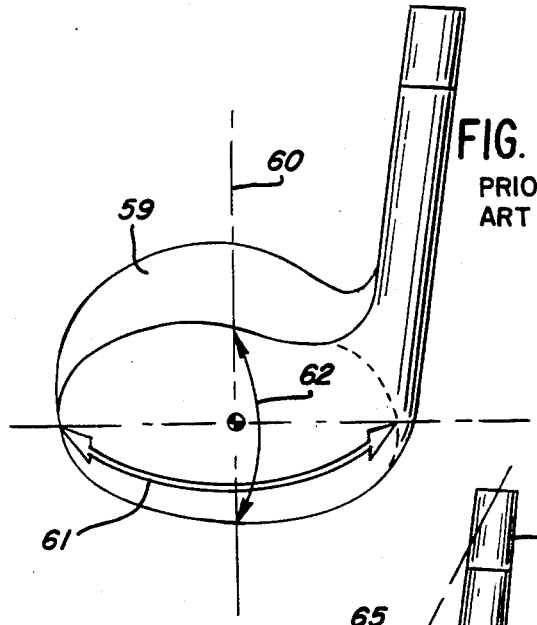
FIG. 15
PRIOR ART
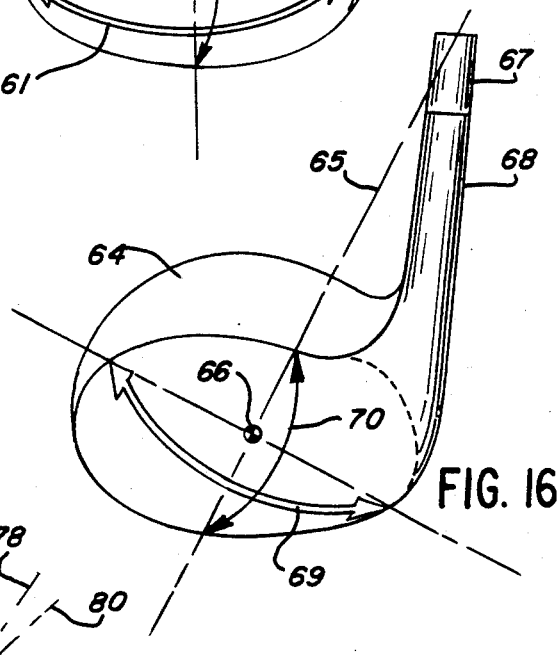
FIG. 16
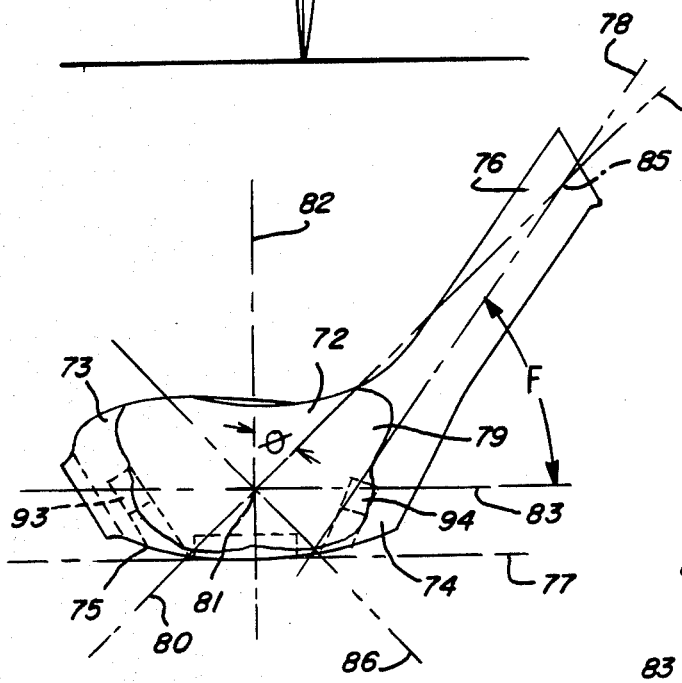
FIG. 17
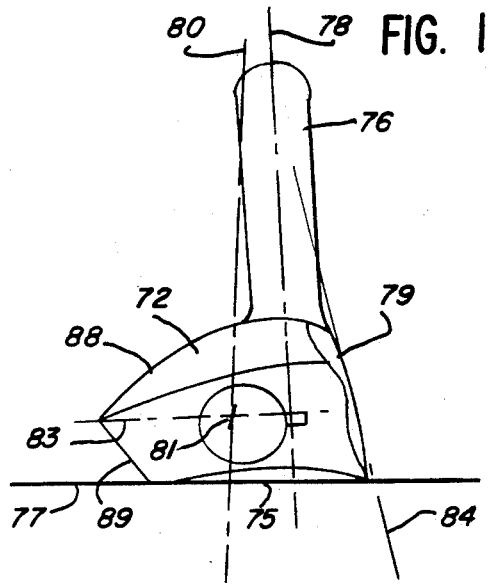
FIG. 18

GOLF CLUB WITH BULGE RADIUS AND INCREASED MOMENT OF INERTIA ABOUT AN INCLINED AXIS

BACKGROUND

This invention relates to golf clubs, and, more particularly, to golf clubs which are designed to provide more accurate off-center hits.

It is commonly assumed that when a golf club strikes a golf ball off center, i.e., at a point spaced from the center of gravity of the club toward the toe or heel, the club rotates about a vertical axis which extends through the center of gravity. When the club strikes the ball at a point above or below the center of gravity, i.e., toward the top or sole of the club, it is assumed that the club tends to rotate about a horizontal axis which extends through the center of gravity.

The foregoing assumptions have resulted in clubs being designed with increased polar moments of inertia about the vertical and horizontal axes in order to reduce the rotation of the club. The moment of inertia about the vertical axis may be increased by concentrating weight of the club in the toe and the heel. The moment of inertia about the horizontal axis may be increased by concentrating weight of the club in the sole and the top.

Wooden clubs, particularly the driver, are conventionally provided with bulge and roll in order to compensate for excessive gear effect. Bulge is convex curvature in the face of the club which can be seen when the face is viewed from above or below. The curvature extends about a vertical axis. Roll is convex curvature in the face which can be seen when the face is viewed from the side. The curvature extends about a horizontal axis. Gear effect in wooden clubs is well known. When a wooden club, e.g., a driver, strikes a golf ball at a point which is offset from the center of the face. i.e., toward the toe or heel of the club, a spin is imparted to the ball. A toe hit on a right-handed club will provide a counterclockwise or hook spin, and a heel hit on a right-handed club will provide a clockwise or slice spin.

The gear effect spin is created by a wooden club because the center of gravity of the club is spaced a substantial distance behind the striking face of the club. When the club strikes a ball on an off-center hit, the clubhead rotates about its center of gravity. The rotation of the clubhead in one direction, e.g., clockwise for a toe hit, causes the ball to rotate in the opposite direction, i.e., counterclockwise for a toe hit. An opposite rotation is imparted to the ball because the clubhead and ball rotate together much like two enmeshed gears. On a heel hit, the club rotates counterclockwise, and a clockwise or slice spin is imparted to the ball.

The clockwise rotation of a wooden clubhead on a toe hit opens the face of the club and causes the ball to fly initially to the right of the intended line of flight. However, the counterclockwise or hook spin imparted to the ball by the gear effect will cause the ball to curve back toward the intended line of flight. In most wooden clubs the gear effect spin more than compensates for the effect of the open face, and the ball would hook to the left of the intended line of flight. For this reason the striking face of a wooden club is provided with bulge, i.e., a curved or convex face. The bulge tends to make a toe hit fly to the right and a heel hit fly to the left. The bulge spin and the gear effect spin are advantageously adjusted so that a ball hit on either the toe or the heel lands approximately along the intended line of flight.

Similarly, when a wooden club strikes a ball above or below the center of gravity, the rotation of the clubhead about the center of gravity imparts gear effect spin on the ball which causes the ball to curve downwardly for a high hit and to curve upwardly for a low hit. The roll curvature is intended to compensate for excessive gear effect spin on high and low hits.

U.S. Pat. No. 3,625,518 describes orienting the bulge curvature of a wooden club about an axis which extends parallel to the axis of the shaft and orienting the roll curvature about an axis which is perpendicular to the first axis. The patent does not precisely describe the manner in which the clubhead rotates at impact. Instead, the orientation of the bulge and roll axes is said to compensate for deviation of the impact from the sweet spot because any tendency to swing out is accompanying by a tendency to raise the club and vice versa. The patent also states that the swing of the club at impact is in a plane passing through the target line and parallel to the shaft.

SUMMARY OF THE INVENTION

We have discovered that a golf club head does not rotate about a vertical axis on toe or heel hits and does not rotate about a horizontal axis on high and low hits. Rather, a toe or heel hit will cause the head to rotate about a first axis which extends through the center of gravity of the clubhead in a plane which intersects the axis of the shaft above the clubhead. A high or low hit will cause the club to rotate about a second axis which extends through the center of gravity perpendicular to the first axis.

If the weight of the clubhead is distributed to increase the moment of inertia and to decrease the tendency of the clubhead to rotate, the weight should be distributed with respect to the actual axes of rotation. Similarly, bulge and roll curvatures on the face of a wood-type club should be oriented with respect to the actual axes of rotation. Bulge should curve about an axis which is parallel to said first axis, and roll should curve about an axis which is parallel to said second axis.

We have also discovered that conventional roll radii are too short, and the resulting curvature produces too much loft for high hits and too little loft for low hits. Increasing the radius of curvature of the roll tends to flatten the roll somewhat but makes the loft angle more nearly uniform from the top to the bottom of the club.

DESCRIPTION OF THE DRAWING

The invention will be explained in conjunction with an illustrative embodiments shown in the accompanying drawing, in which FIG. 1A is a diagrammatic illustration of a toe hit on a wood-type golf club;

FIG. 1B is an illustration similar to FIG. 1A showing a heel hit;

FIG. 2A is a diagrammatic illustration of gear effect spin being imparted to the golf ball by a toe hit;

FIG. 2B is an illustration of gear effect spin being imparted to a ball by a heel hit;

FIG. 3 is an illustration view of a pair of enmeshed gears rotating in opposite directions;

FIG. 14 is a diagrammatic illustration of high, center, and low hits on a conventional wood-type club;

FIG. 15 is a diagrammatic illustration of the orientation of bulge and roll on a conventional wood-type club;

FIG. 16 is a diagrammatic illustration of the orientation of bulge and roll on a wood-type club formed in accordance with the invention;

FIG. 17 is a front elevational view of a wood-type club formed in accordance with the invention;

FIG. 18 is a side elevational view of the club of FIG. 17;

DESCRIPTION OF SPECIFIC EMBODIMENTS

Figure 4A:
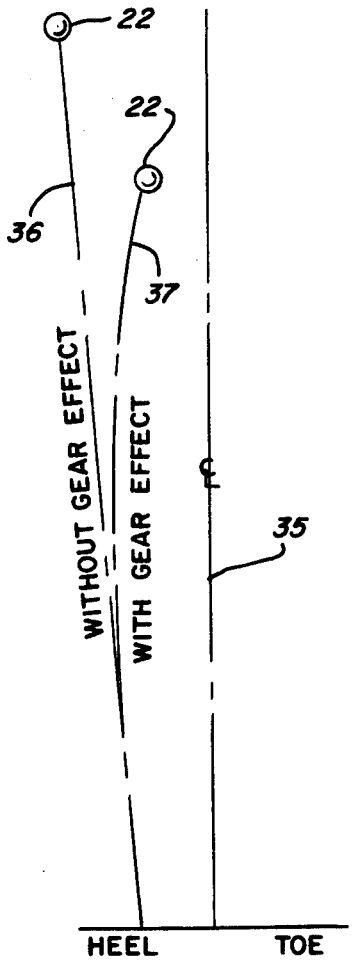
FIG. 4A PRIOR ART
FIG. 4A is a diagrammatic illustration of heel hits on clubs with and without gear effect.

FIGS. 1A and 2A illustrate a toe hit of a golf ball 22 by a clubhead 23 of a wood-type club which provides gear effect spin. The clubhead includes a striking face 24, a toe 25, a heel 26, and a hosel 27. The center of gravity 28 is located a distance y behind the face. The clubhead is swung toward the ball in the direction of the arrow 29, and the clubhead contacts the ball at a point which is toward the toe of the club.

The impact of the ball on the clubhead causes the clubhead to rotate clockwise about its center of gravity (FIG. 2A). The ball is impacted against the clubhead while the clubhead rotates, and the clockwise rotation of the clubhead in the direction of the arrow 30 causes the ball to rotate counterclockwise in the direction of the arrow 31.

The initial impact between the ball and the clubhead occurs at a point $A_1$ on the club and point $B_1$ on the ball. The impact point $A_1$ is a distance $R_c$ from the center of gravity of the clubhead. As the clubhead rotates clockwise to its FIG. 2A position, the ball will rotate counterclockwise so that the point $B_2$ on the ball contacts the point $A_2$ on the clubhead.

The counterclockwise spin imparted to the ball by the clockwise rotation of the clubhead is similar to the rotation of mating gears 32 and 33 shown in FIG. 3. Rotation of the gear 32 in a clockwise direction causes counterclockwise rotation of the gear 33.

A heel hit is illustrated in FIGS. 1B and 2B. The impact between the ball 22 and the clubhead 23 occurs at point $B_1$ on the ball and point $A_1$ on the club. The heel hit causes the clubhead to rotate counterclockwise (FIG. 2B), and the ball rotates clockwise so that the point $B_0$ on the ball contacts the clubhead at $A_2$.

FIG. 4A illustrates the result of gear effect spin on a heel hit. If the club face is moving in the direction of the centerline or intended line of flight 35, a heel hit will cause the club face to close and will initially send the ball in the direction of the line 36. However, the clockwise slice spin imparted on the ball by the counterclockwise rotation of the clubhead causes the ball to slice back toward the intended line of flight as indicated by the line 37.

Figure 4B:
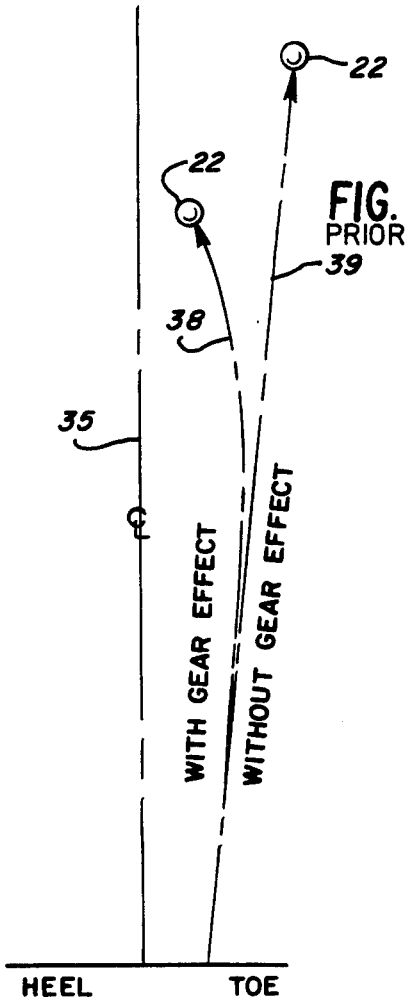
FIG. 4B PRIOR ART
FIG. 4B is a diagrammatic illustration of toe hits on clubs with and without gear effect.

Conversely, a toe hit on a club with gear effect as illustrated in FIG. 4B will impart a counterclockwise spin to the ball and will cause the ball to curve to the left from its original direction indicated along the line 38 away from its original direction indicated by the line 39.

Figure 5A:
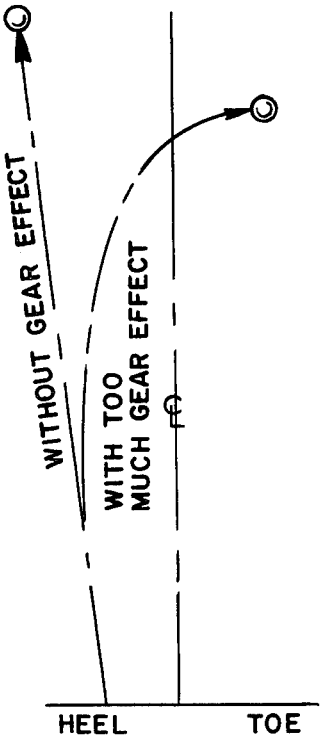
FIG. 5A PRIOR ART
FIG. 5A is an illustration of heel hits on clubs without gear effect and with too much gear effect.
Figure 5B:
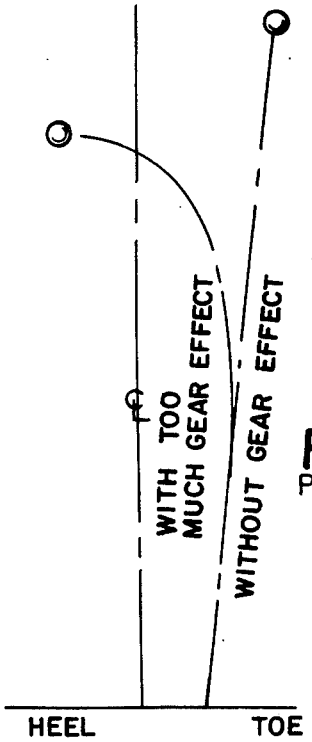
FIG. 5B PRIOR ART
FIG. 5B is an illustration of toe hits on clubs without gear effect and with too much gear effect.

It can also be seen that too much gear effect spin can be imparted to the ball if the clubhead rotates too much. This is illustrated in FIGS. 5A and 5B. FIG. 5A illustrates the flight of a ball which has excessive slice spin because of a heel hit, and FIG. 5B illustrates the flight of a ball which has excessive hook spin because of a toe hit. If the moment of inertia or radius of gyration with respect to the center of gravity is too low, the clubhead will rotate excessively on off-center hits.

Figure 6:
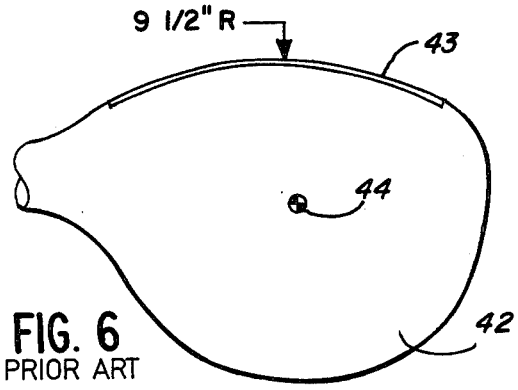
FIG. 6 PRIOR ART
FIGS. 6 and 7 are top plan views of clubs with different bulge radii.

Some clubs have been designed with increased moments of inertia to reduce the rotation of the clubhead on off-center hits. The weight distribution is generally made on the assumption that the clubhead rotates about a vertical axis through the center of gravity. If the rotation of the clubhead is reduced, the compensating bulge curvature can also be reduced. FIG. 6 illustrates a wood-type clubhead 42 which is provided with conventional bulge, i.e., the striking face 43 curves about an axis which extends parallel to a vertical axis through the center of gravity 44. The plane in which these two axes lie is generally perpendicular to a plane which is tangent to the center of the face. In FIG. 6 the radius of the bulge curvature is 9½ inches.

Figure 8:
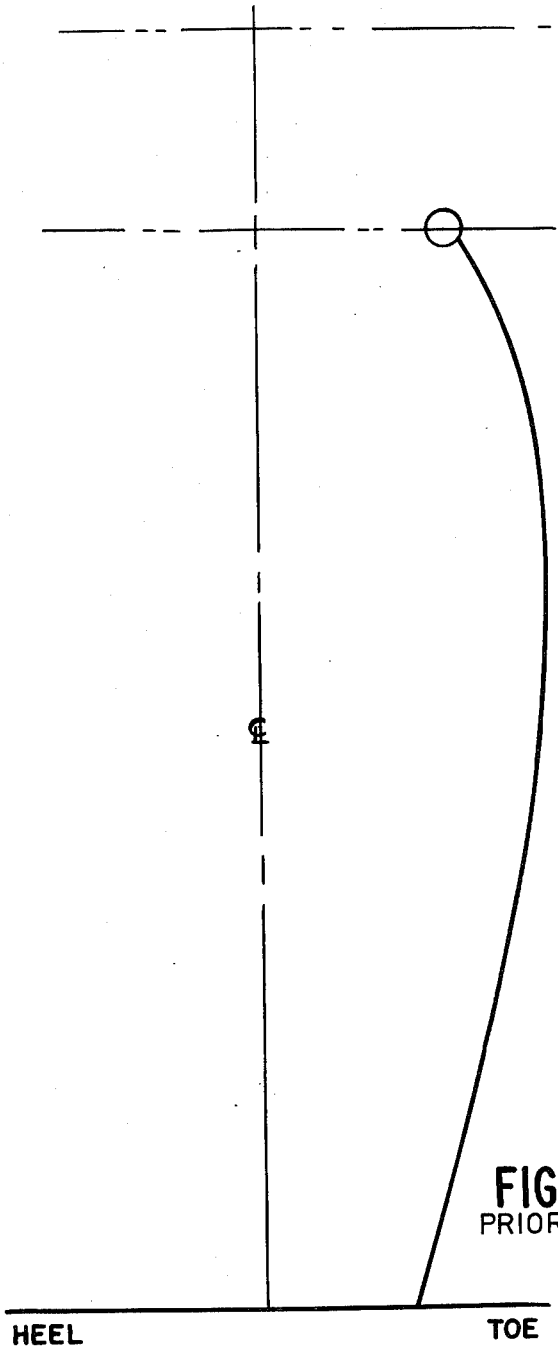
FIG. 8 PRIOR ART
FIGS. 8 and 9 are diagrammatic illustrations of toe hits on the clubs of FIGS. 6 and 7, respectively.

If the moment of inertia about a vertical axis through the center of gravity 44 is increased by redistributing the weight of the head, the rotation of the clubhead and therefore the gear effect spin will be reduced on off-center hits. As a result, a conventional 9½ inch bulge radius on the face 43 will cause a toe hit to remain to the right of the intended line of flight as illustrated in FIG. 8. Similarly, a heel hit will remain to the left of the intended line of flight.

Figure 9:
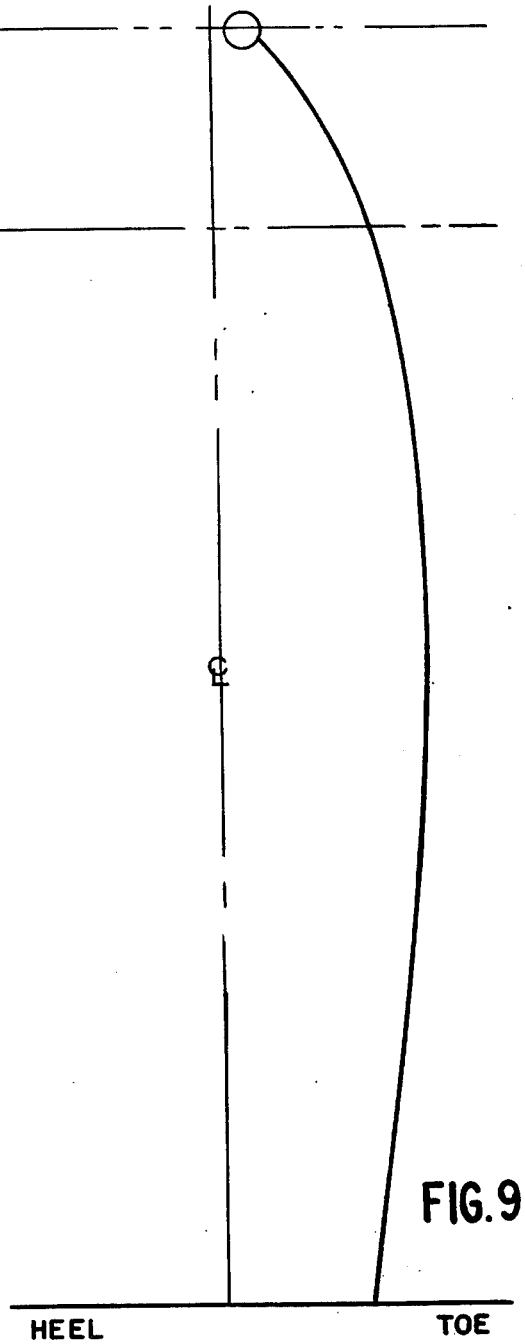
Figure 7:
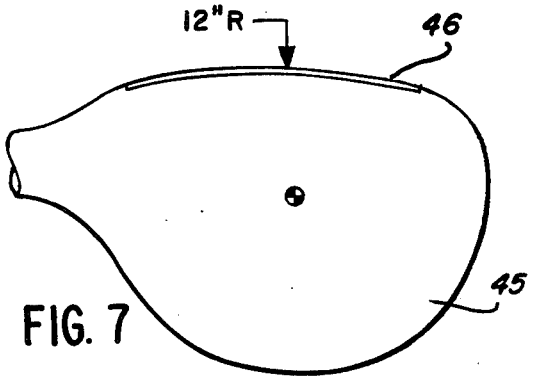

When the weight of the clubhead is redistributed to increase the moment of inertia, the bulge radius can be increased as illustrated in FIG. 7. A clubhead 45 has a striking face 46 with a 12 inch bulge radius. The reduced curvature of the face will cause the ball to land closer to the intended line of flight on off-center hits as illustrated in FIG. 9. Also, less of the impact energy will be converted into spin energy, and the ball will fly farther as can be seen by comparing FIGS. 8 and 9.

Figure 11:
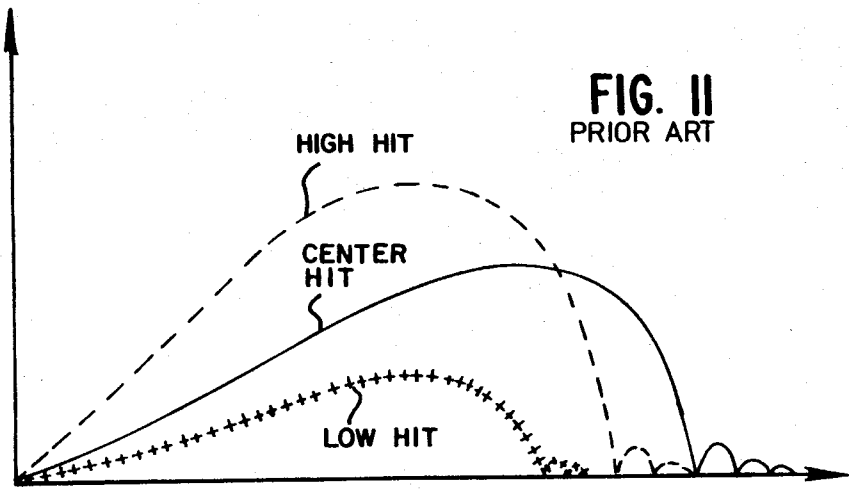
FIG. 11 PRIOR ART
FIG. 11 is a diagrammatic illustration of high, center, and low hits on the club of FIG. 10.
Figure 10:
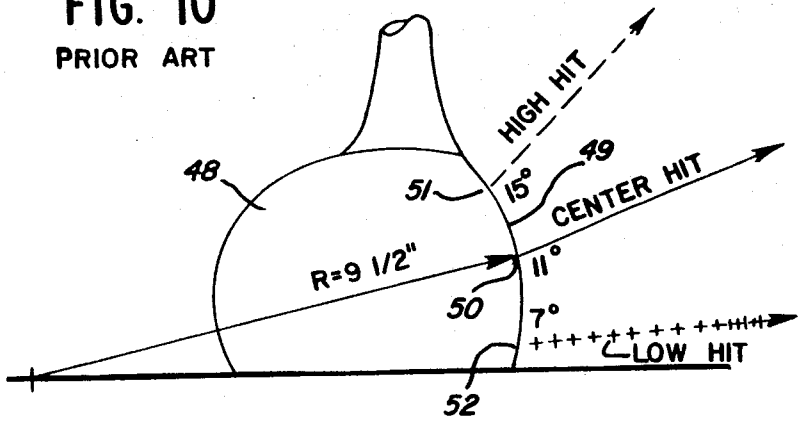
FIG. 10 PRIOR ART
FIG. 10 is a side elevational view of a conventional clubhead with a 9½" roll radius.

The accuracy of a wood-type club can also be increased by increasing the roll radius. FIG. 10 illustrates a conventional wood-type club 48 having a striking face 49 with a 9½ inch roll radius. A plane tangent to the center 50 of the face determines the loft angle. A conventional driver might have a loft angle of 11°. However, because of the roll curvature the loft angle at a point 51 at the top of the face is about 15°, and the loft angle at a point 52 at the bottom of the face is about 7°. This 8° variation in loft from top to bottom causes high hits, i.e., balls hit near the top of the face, to fly too high and low hits to fly too low, resulting in decreased distance. The comparison of high, center, and low hits is illustrated in FIG. 11.

Figure 12:
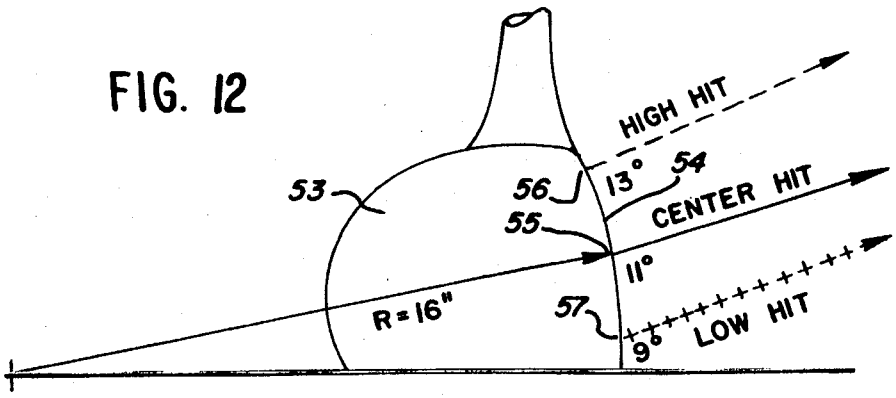
FIG. 12 is a side elevational view of a clubhead with an increased roll radius.

FIG. 12 illustrates a club 53 having a striking face 54 on which the roll radius has been increased to 16 inches. The loft at the center 55 of the face is still 11°. However, the reduced roll curvature reduces the variations in loft at the top and bottom. The loft at point 56 is 13°, and the loft at point 57 is 9°.

Figure 13:
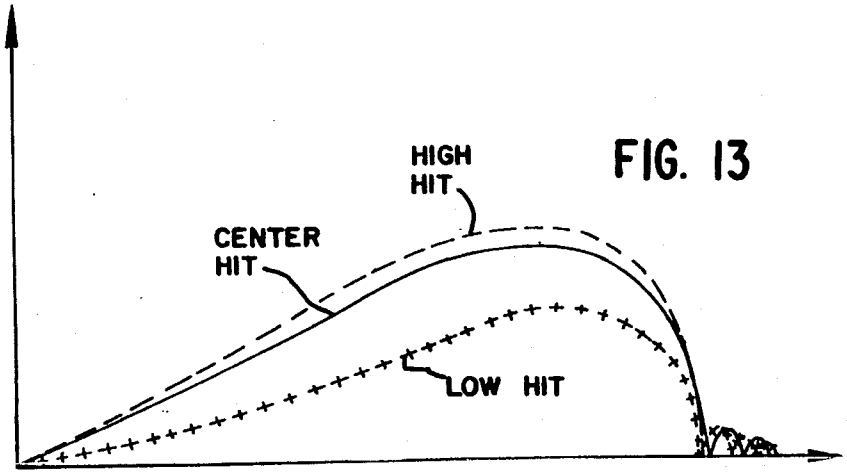
FIG. 13 is a diagrammatic illustration of high, center, and low hits on the club of FIG. 12.

The reduced variation in loft angle results in more uniform ball trajectories for high, center, and low hits, and increases the distance of high and low hits as illustrated in FIG. 13.

As previously stated, it is commonly assumed that a clubhead rotates about a generally vertical axis on off-center hits. Referring to FIG. 15, a clubhead 59 is assumed to rotate about a vertical axis 60 which extends through the center of gravity of the clubhead. This assumption leads to the conventional design in which the bulge curvature curves about an axis which is parallel to the axis 60 as illustrated by the arrow 61 and the roll radius curves about an axis which is perpendicular to the axis 60 as illustrated by the arrow 62.

We have discovered that the true axis of rotation is substantially inclined from the vertical and lies in a plane which intersects the axis of the shaft. This can be demonstrated on a club-swinging machine by striking the ball at various points on the face of a club which lie along a vertical centerline formed on the face by a vertical plane which extends through the center of gravity and through the center of the face. A center hit, i.e., a hit on the line at the same height as the center of gravity will fly straight as illustrated in FIG. 14. However, a high hit will fly to the left, and a low hit will fly to the right as illustrated in FIG. 14. If the clubhead really rotated about a vertical axis through the center of gravity, high and low hits along the vertical centerline would not cause the club to rotate and would fly straight.

The true axis of rotation of a clubhead is illustrated in FIG. 16. The clubhead 64 rotates about an axis 65 which extends through the center of gravity 66 of the clubhead and which lies in a plane which intersects the shaft 67 at a point below the grip of the shaft. It is believed that for most clubs this plane intersects the axis or centerline of the shaft at about the top of the hosel 68 and that the axis of rotation is inclined about 35° to 55° from the vertical. The bulge curvature should therefore curve about an axis which extends parallel to the axis 65 as illustrated by the arrow 69, and the roll curvature should curve about an axis which extends perpendicular to the axis 65 as illustrated by the arrow 70.

A wood-type clubhead 72 designed in accordance with the invention is illustrated in FIGS. 17 and 18. The clubhead has a toe portion 73, a heel portion 74, and a sole portion 75. A hosel 76 extends at an angle F from the horizontal plane 77 when the center of the sole is tangent to the horizontal plane. The angle F is the lie angle of the club. The hosel has an axis or centerline 78, and the shaft of the club is attached to the hosel so that it extends along the centerline 78.

The striking face 79 of the club is provided with a convex bulge curvature which curves about an axis which is parallel to the axis 80. The axis 80 is the assumed true axis of rotation and extends through the center of gravity 81 at an angle $\theta$ from the vertical in FIG. 17. In the preferred embodiment the axis of the bulge curvature was about 12 inches behind the face to provide a bulge radius of about 12 inches.

The axis of rotation 80 and the axis of the bulge curvature lie in a plane which extends through the center of gravity and through the center of the striking face, i.e., the point on the face which is formed by vertical and horizontal planes 82 and 83 which extend through the center of gravity. The plane in which the axis 80 lies is perpendicular to a plane 84 (FIG. 18) which is tangent to the center of the striking face, and the plane in which the axis 80 lies intersects the axis 78 of the shaft at a point 85 which is just below the top of the hosel 76.

FIG. 18 is a side elevational view from a plane which is perpendicular to the plane 84 which is tangent to the center of the striking face. A plane which passes through the axis of rotation 80 and which is perpendicular to the plane of FIG. 18 will intersect the axis 78 of the shaft at a point below the grip of the shaft.

The face 79 is also provided with a convex roll curvature which curves about an axis which is perpendicular to the axis 80, i.e., parallel to the axis 86. The axis of the roll curvature and the axis 86 lie in a plane which passes through the center of gravity and which extends perpendicularly to the aforementioned plane in which the bulge axis and the axis 80 lie. In the preferred embodiment the axis of the roll curvature was about 16 inches behind the face to provide a roll radius of about 16 inches.

A convex top surface 88 (FIG. 18) curves rearwardly from the face 79, and a rear surface 89 extends downwardly and forwardly to the sole.

In one specific embodiment for a driver, the lie angle F was 55°, and the angle $\theta$ of inclination of the axis of rotation 80 from the vertical was 45°. The plane in which the axis 80 and the bulge axis lie intersected the centerline of the shaft at an angle of about 10°.

Figure 19:
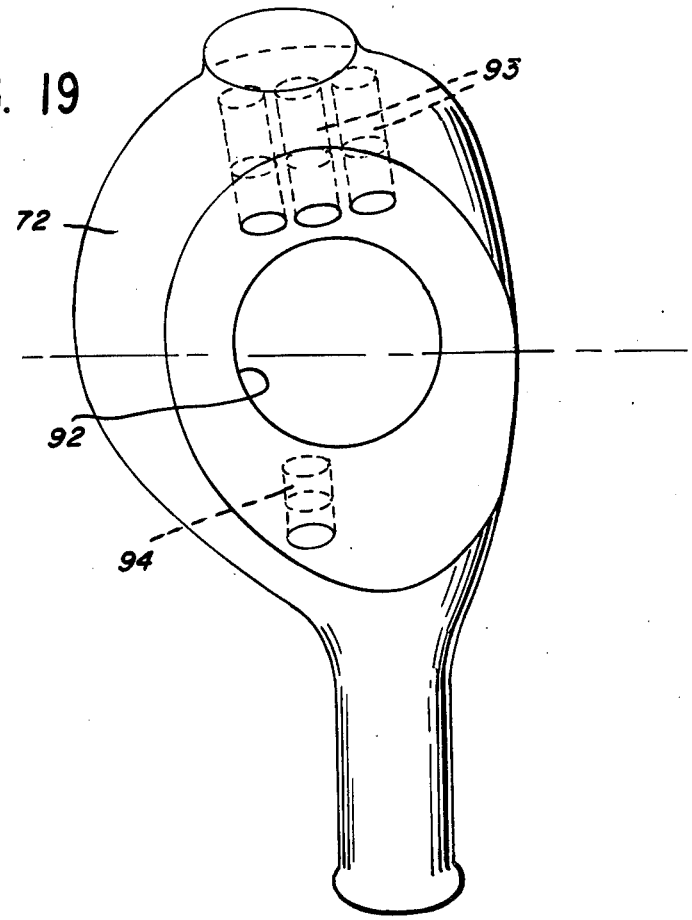
FIG. 19 is a bottom view of the club of FIG. 17.

Referring to FIG. 19, the moment of inertia of a club designed in accordance with the invention can be increased by redistributing the weight of the club about the true axis of rotation. The clubhead 72 is provided with a generally cylindrical recess 92 which extends upwardly from the sole of the clubhead to reduce the weight of the clubhead at the center. Three weights 93 are inserted into inclined bores which are drilled into the toe of the clubhead, and a weight 94 is inserted into an inclined bore which is drilled into the heel of the clubhead.

The weights 93 and 94 are located to increase the moment of inertia along the true axis of rotation as illustrated in FIGS. 16 and 17 rather than along a vertical assumed axis of rotation. The weights therefore will reduce the tendency of the clubhead to rotate about its true axis of rotation and will decrease the amount of impact energy which is converted in spin energy of the ball.

The terms "wood" and "wood-type" as used herein are not limited to real wood and are meant to include clubheads which are shaped like traditional wooden clubheads but which are made of metal, plastic, and other materials.

Figure 20:
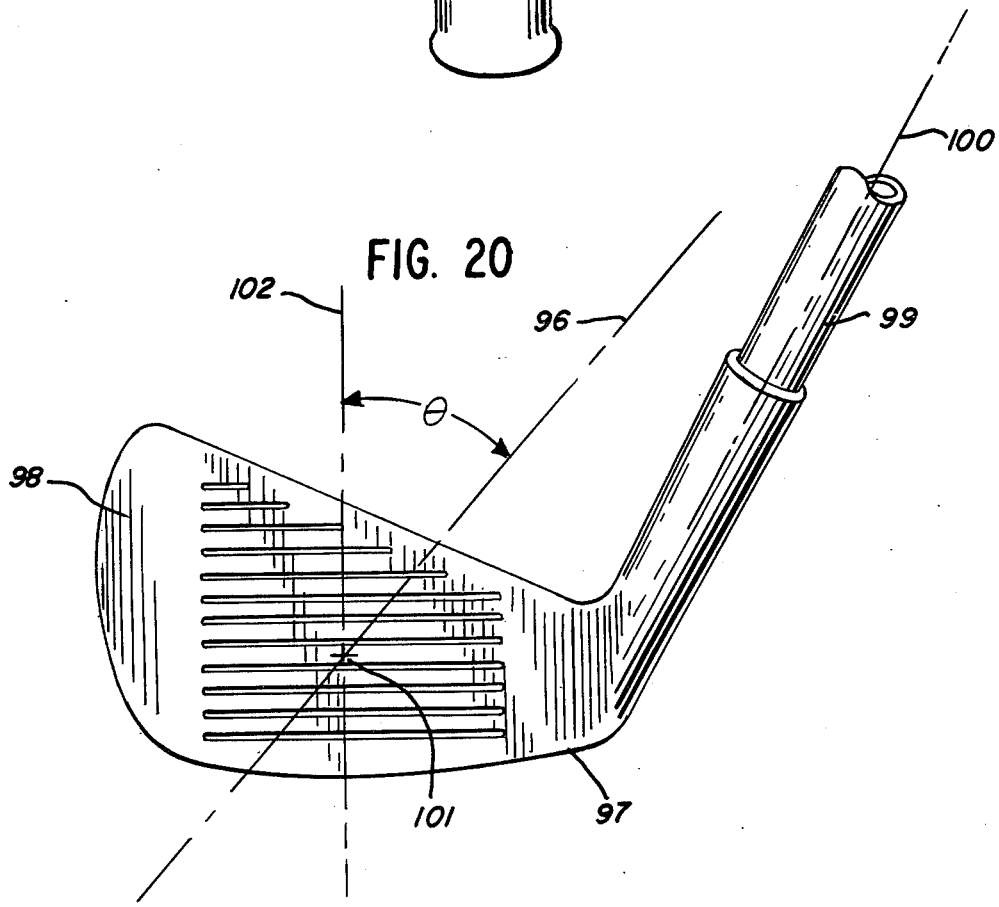
FIG. 20 is a front elevational view of an iron club showing the axis of rotation of the club.

FIG. 20 illustrates the axis of rotation 96 of an iron club 97. The iron club includes a clubhead 98 and a shaft 99 which has a centerline or axis 100. The axis 96 passes through the center of gravity 101 and lies in a plane which intersects the shaft axis 100 between the grip and the clubhead. The axis 96 is inclined at an angle $\theta$ from the vertical line 102.

While in the foregoing specification a detailed description of specific embodiments of the invention were set forth for the purpose of illustration, it will be understood that many of the details herein given may be varied considerably by those skilled in the art without departing from the spirit and scope of the invention.

I claim:

1. A wood-type golf club comprising a clubhead and a shaft attached to the clubhead, the clubhead comprising a body having a toe portion and a heel portion, a top surface, a sole surface, and a striking face extending between the top and sole surfaces, the striking face having a convex curvature about a first axis which extends parallel to a second axis which extends through the center of gravity of the clubhead, said first and second axes lying in a plane which extends through the center of the striking face and which intersects the centerline of the shaft above the clubhead.

2. The golf club of claim 1 in which said first plane extends at an angle of about 35° to about 55° with respect to a second plane which passes through the center of the striking face and the center of gravity of the clubhead, said second plane being perpendicular to a third plane which is tangent to the center of the sole surface.

3. The golf club of claim 1 in which said plane intersects the centerline of the shaft at an angle of about 10°.

4. The golf club of claim 1 in which said clubhead includes a hosel which is connected to the shaft, said plane intersects the centerline of the shaft adjacent the top of the hosel.

5. The golf club of claim 1 in which said first axis is about 12 inches behind the striking face whereby the radius of curvature of said convex curvature is about 12 inches.

6. The golf club of claim 1 including first and second weights in the clubhead on opposite sides of said plane.

7. The golf club of claim 1 in which the striking face has a second convex curvature about a third axis which extends parallel to a fourth axis which extends through the center of gravity of the clubhead, said third and fourth axes lying in a plane which extends through the center of the striking face and perpendicular to said second axis.

8. The golf club of claim 7 in which said third axis is 16 inches behind the striking face whereby the radius of curvature of said second convex curvature is 16 inches.

9. The golf club of claim 1 in which said first plane extends at an angle of about 45° with respect to a second plane which passes through the center of the striking face and the center of gravity of the clubhead, said second plane being perpendicular to a third plane which is tangent to the center of the sole surface.

10. A wood-type golf club comprising a clubhead and a shaft attached to the clubhead, the clubhead comprising a body having a toe portion and a heel portion, a top surface, a sole surface, and a striking face extending between the top and sole surfaces, the striking face having a convex roll curvature about a first axis which extends parallel to a second axis which extends through the center of gravity of the clubhead, said first and second axes lying in a first plane which extends through the center of gravity of the clubhead and which is perpendicular to a second plane which is tangent to the center of the striking face, said first axis being about 16 inches behind the striking face whereby the radius of said roll curvature is about 16 inches.

11. The golf club of claim 10 in which the loft angle of the striking face at the intersection of said first and second planes is about 11°, the loft angle of the striking face at the intersection of said second plane and the top of the striking is about 13°, and the loft angle of the striking face at the intersection of said second plane and the bottom of the striking face is about 9°.

12. The golf club of claim 10 in which said first plane is perpendicular to a second plane which extends through the center of gravity of the clubhead and the center of the striking face and which intersects the centerline of the shaft about the clubhead.

13. The golf club of claim 12 in which said second plane extends at an angle of about 35° to about 55° with respect to a third plane which passes through the center of the striking face and the center of gravity of the clubhead, said third plane being perpendicular to a fourth plane which is tangent to the center of the sole surface.

14. The golf club of claim 12 in which said second plane intersects the centerline of the shaft at an angle of about 10°.

* * * * *

UNITED STATES PATENT AND TRADEMARK OFFICE

CERTIFICATE OF CORRECTION

PATENT NO. : 4,471,961

DATED : September 18, 1984

INVENTOR(S) : Mohammad Masghati et al

It is certified that error appears in the above-identified patent and that said Letters Patent is hereby corrected as shown below:

Col. 7, line 25 change the comma to --and--.

Col. 8, lines 18 and 20 delete "about".

Signed and Sealed this

*Twelfth* Day of *February 1985*

[SEAL]

*Attest:*

DONALD J. QUIGG

*Attesting Officer* *Acting Commissioner of Patents and Trademarks*